United States Patent [19]

Grecksch et al.

[11] Patent Number: 4,801,108

[45] Date of Patent: Jan. 31, 1989

[54] BOBBIN WINDING MACHINE

[75] Inventors: Hans Grecksch, Monchengladbach; Leo Tholen, Heinsberg; Edmund Wey, Nettetal, all of Fed. Rep. of Germany

[73] Assignee: W. Schlafhorst & Co., Fed. Rep. of Germany

[21] Appl. No.: 137,481

[22] Filed: Dec. 23, 1987

[30] Foreign Application Priority Data

Dec. 24, 1986 [DE] Fed. Rep. of Germany ..... 3644432

[51] Int. Cl.[4] ..... B65H 54/02; B65H 67/06

[52] U.S. Cl. ..... 242/35.5 A; 242/35.5 R; 242/35.6 R

[58] Field of Search ..... 242/35.5 A, 35.5 R, 242/35.6 R, 18 R

[56] References Cited

U.S. PATENT DOCUMENTS

| | | | |
|---|---|---|---|
| 3,111,280 | 11/1963 | Reiners et al. | 242/35.5 R |
| 3,217,235 | 11/1965 | Kieronski | 242/35.5 A |
| 3,279,710 | 10/1966 | Raasch | 242/35.5 R |
| 3,279,712 | 10/1966 | Furst | 242/35.5 R |
| 3,358,940 | 12/1967 | Beckwith, Jr. et al. | 242/35.5 R |
| 3,389,866 | 6/1968 | Mullers | 242/35.5 R |
| 3,951,350 | 4/1976 | Uchida | 242/35.5 A |
| 3,998,397 | 12/1976 | Haberkorn et al. | 242/35.5 A |
| 4,558,829 | 12/1985 | Aretz et al. | 242/35.5 A |
| 4,589,602 | 5/1986 | Reiners et al. | 242/35.5 R |
| 4,619,416 | 10/1986 | Matsui et al. | 242/35.5 A |
| 4,664,326 | 5/1987 | Grecksch et al. | 242/35.5 A |
| 4,723,720 | 2/1988 | Matsui et al. | 242/35.5 A |
| 4,723,722 | 2/1988 | Roller | 242/35.5 A |

FOREIGN PATENT DOCUMENTS

| | | |
|---|---|---|
| 1256571 | 12/1967 | Fed. Rep. of Germany . |
| 1560408 | 7/1969 | Fed. Rep. of Germany . |
| 3426655 | 2/1985 | Fed. Rep. of Germany . |
| 3617151 | 11/1986 | Fed. Rep. of Germany . |

*Primary Examiner*—Stanley N. Gilreath

*Attorney, Agent, or Firm*—Shefte, Pinckney & Sawyer

[57] ABSTRACT

An improvement in a multi-station bobbin winding machine having an active cop unwinding position and replacement cop reserve position at each winding station with a movable reserve cop receptacle at the reserve position, wherein a yarn suction device is affixed at each winding station to the receptacle for disposition adjacent a nose portion of a reserve cop received thereby for locating and retaining a leading yarn end of the reserve cop, without obstructing operator access to the winding station.

7 Claims, 3 Drawing Sheets

BOBBIN WINDING MACHINE

BACKGROUND OF THE INVENTION

The present invention relates to textile winding machines and, more particularly, to a bobbin winding machine of the type having a plurality of winding stations whereat a first yarn cop is disposed in an active delivery position for yarn unwinding therefrom and at least one other cop is stored in a reserve position.

In bobbin winding machines of the aforementioned type, a cop conveyor system is typically provided with associated devices for transferring reserve cops from the conveyor system to the respective reserve positions at the plural winding stations. Alternatively, cops may be fed manually into the reserve positions. A cop receptacle is provided at each reserve position in association with the transport plane of the conveyor system and is switchably movable from a flat position for receiving reserve cops from the conveyor system into an inclined position for discharging a reserve cop for automatic transferral from the reserve position to the delivery position. Yarn cops typically comprise a yarn tube about which a quantity of yarn is wound, with the opposite nose and foot ends of the tube remaining exposed, a reserve cop preferably being introduced into the receptacle with its foot portion oriented as the leading end of the cop.

Prior to the placement of reserve cops into the reserve positions, the leading end of the yarn wound thereon is usually placed in a predetermined location, such as either setting the leading yarn end on the cop nose or inserting the yarn end into the interior bore through the yarn supporting tube, thereby to prepare the reserve cop for subsequent unwinding operation. Generally, such preparatory measures are performed at automatic cop preparing stations which may be set up at one end of the bobbin winding machine or may be separate therefrom and from which the prepared cops are automatically fed to the cop conveyor system.

Such a cop conveyor system may comprise, for example, a conveyor belt on which the prepared cops are placed in alignment with one another and from which the cops are fed as needed to the receptacles at the reserve positions of the winding machine. For this purpose, controllable switching devices may be provided in association with the conveyor at each winding station for deflecting a cop from the conveyor into the receptacle at a winding station whose reserve position is empty. A representative cop conveyor system with associated switching devices of the above-described type is disclosed in detail in German Offenlegungsschrift DE-OS No. 35 14 935. In the apparatus of this application, a cop receptacle at the reserve position is switchable from a generally flat cop-receiving position into a relatively inclined position wherein the tube nose of a reserve cop within the receptacle is brought adjacent to a controllable yarn suction device which is operable to attract the leading yarn end of the reserve cop from within the bore of its supporting tube and holds the yarn end so as to be ready for introduction into the yarn winding station. A disadvantage of this apparatus, however, is that the yarn suction device makes access to the winding station more difficult, such as for example may be necessary for making manual corrections or adjustments.

SUMMARY OF THE INVENTION

It is accordingly an object of the present invention to provide an improved bobbin winding machine of the basic aforedescribed type wherein a yarn suction device is provided without obstructing access to the winding station. According to the present invention, the foregoing object is achieved by providing a yarn suction device at each station which is affixed to its cop receptacle for disposition adjacent the nose portion of a reserve cop received thereby for locating and retaining a leading end of the yarn of the reserve cop. In this manner, the yarn suction device moves with the receptacle at the reserve position so as to avoid obstruction of access to the winding station.

In the preferred embodiment, the yarn suction device comprises a suction body of a generally rounded configuration to partially surround the nose portion of a reserve cop received by the receptacle, with a suction nozzle being defined by the suction body for disposition adjacent the nose portion of the reserve cop. It is particularly advantageous to form the suction nozzle as an elongated slot oriented to extend generally parallel to the reserve cop, which avoids any need to specially adapt the suction device for proper positioning with respect to cops of differing lengths or having differing yarn windings at the nose portion. Preferably, the suction slot is located generally at a bottom portion of the interior of the suction body. Further, in order to assure a reliable connection of the suction nozzle to a suitable vacuum source throughout movement of the cop receptacle, the suction nozzle may be connected to a suction line extending through the axis of a bearing by which the receptacle is pivotably mounted for movement between its cop-receiving and discharging dispositions.

It is also preferred that a blower nozzle be arranged for directing a positive air flow axially into the foot portion of the tube of a reserve cop received by each receptacle. Additionally, a stop member having guide portions is arranged for engagement with the foot portion of the reserve cop when the receptacle is in its receiving disposition. In this manner, the positive air flow assists the suction device in locating and drawing the leading yarn end from the reserve cop so as to overcome occasional situations in which the yarn end may catch on the wall surface of the cop tube.

DESCRIPTION OF THE PREFERRED EMBODIMENT

Figure 1:
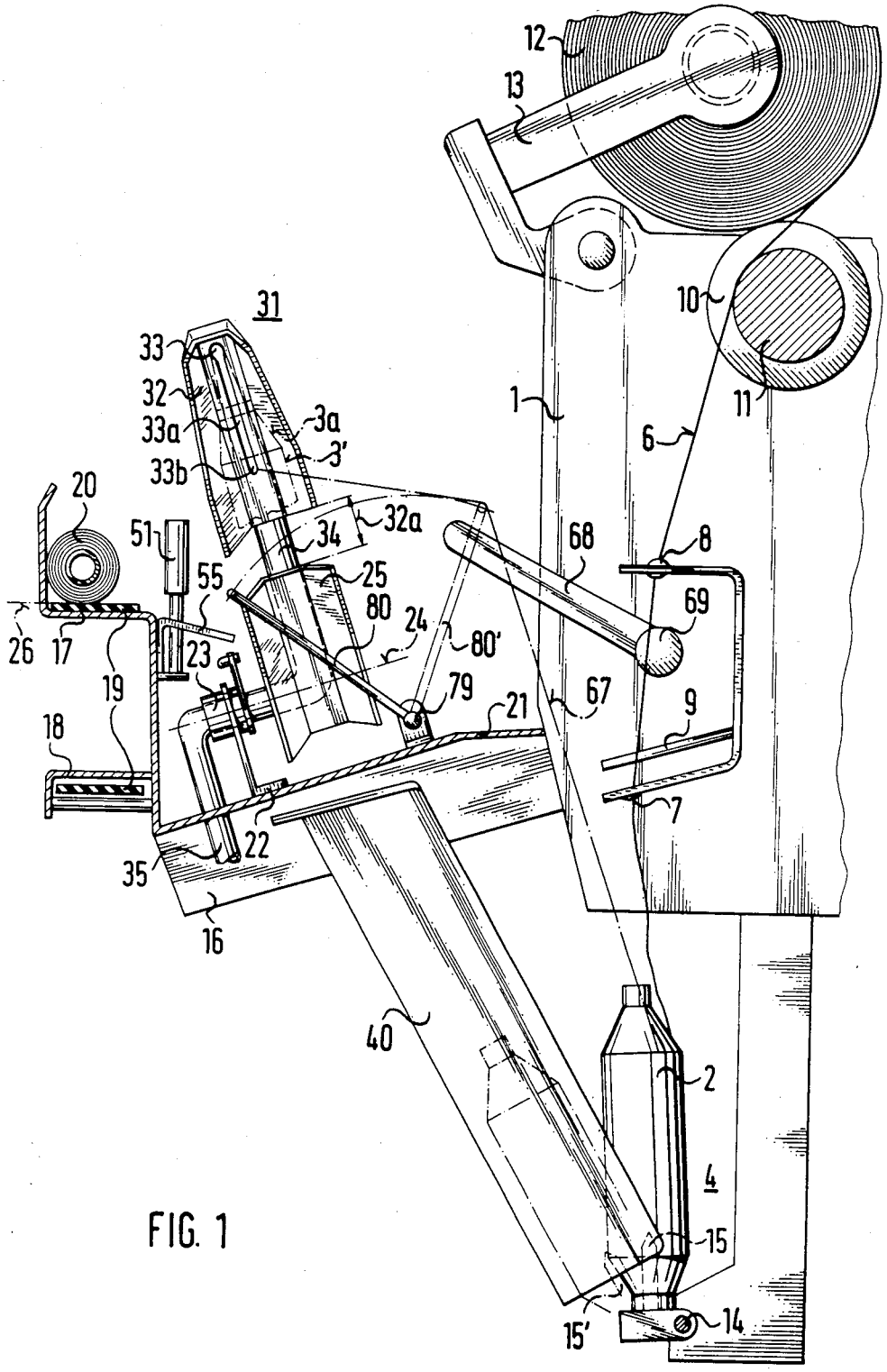
FIG. 1 is a view, partially in end elevation and partially in vertical cross-section, of one winding station of a bobbin winding machine according to the preferred embodiment of the present invention.

Referring now to the accompanying drawings, the present invention is described herein as embodied in a bobbin winding machine of the type disclosed in the aforementioned German Offenlegungsschrift DE-OS No. 35 14 935, although those persons skilled in the art will readily recognize and understand that the present invention is of a broader utility and application and may therefore be readily adapted for operation with other winding machines as well.

In the accompanying drawings, the bobbin winding machine is not shown in complete detail. As will be understood, the winding machine includes a plurality of winding stations arranged longitudinally along the machine, only a single winding station 1 being illustrated in the drawings.

At the winding station 1, a yarn 6 is withdrawn from an active cop 2 located in an unwinding delivery position 4 and the yarn 6 is guided therefrom through yarn guide eyelets 7,8, past a yarn sensor 9, and trained through a reverse threading groove 10 on a yarn guide roller 11 by which the yarn 6 is directed in cross-wound fashion peripherally onto a bobbin 12 rotatable mounted in a creel 13 to rest on the yarn guide roller 11.

At the delivery position 4, an upstanding cop support pin 15 is pivotably mounted on a shaft 14 to permit pivotal movement of the support pin 15 between its position shown in broken lines at 15 and 15' in FIG. 1.

A bracket 16 is provided at each winding station, on which guide plates 17,18 are mounted in parallel horizontal disposition for traveling movement therealong of the upper and lower runs of a conveyor belt 19. As seen in FIG. 1, cops 20 are transported in respectively aligned disposition along the upper run of the conveyor belt 19 from a cop preparing device (not shown) of the aforementioned type.

The bracket 16 also includes a generally flat plate 21 on which a bearing block 22 is mounted in upstanding disposition for supporting a bearing 23 by which a cop receptacle 25 is mounted to the block 22 for pivotal movement at a cop reserve position 5 adjacent the conveyor 19. The receptacle 25 is preferably configured of a trough-like shape for supporting a yarn cop. The bearing 23 is arranged for pivotal movement of the trough-like receptacle 25 about an axis 24 between a generally flat disposition of the receptacle 25 extending generally alongside and slightly below the upper run of the conveyor belt 19 (FIG. 2) and an upwardly inclined disposition, shown in FIG. 1.

In the flat disposition of the trough-like receptacle 25, the receptacle 25 is disposed sufficiently below the transport plane 26 of the upper run of the conveyor belt 19 that a cop 20 thereon may be laterally displaced from the conveyor belt 19 during its movement in the direction of arrow 27 by a pivotable switching lever 51 so as to roll from the conveyor belt 19 along a slightly inclined deflection plate 55 (FIG. 1) and drop therefrom into the cop-receiving receptacle 25. The mechanism of the switching lever 51 is described in greater detail in the aforementioned German Offenlengungsschrift DE-OS No. 35 14 935 and need not be more fully described herein. In the inclined disposition of the trough-like receptacle 25 shown in FIG. 1, the receptacle 25 is oriented to discharge a reserve cop 3' received therein for transferral onto the supporting pin 15 in its pivoted disposition 15' at the delivery position 4, as more fully described hereinafter.

In this basic manner, a reserve cop 20 may be transferred from the upper run of the conveyor belt 19 into the reserve position 5 (FIG. 2) and therefrom into the unwinding delivery position 4.

Figure 2:
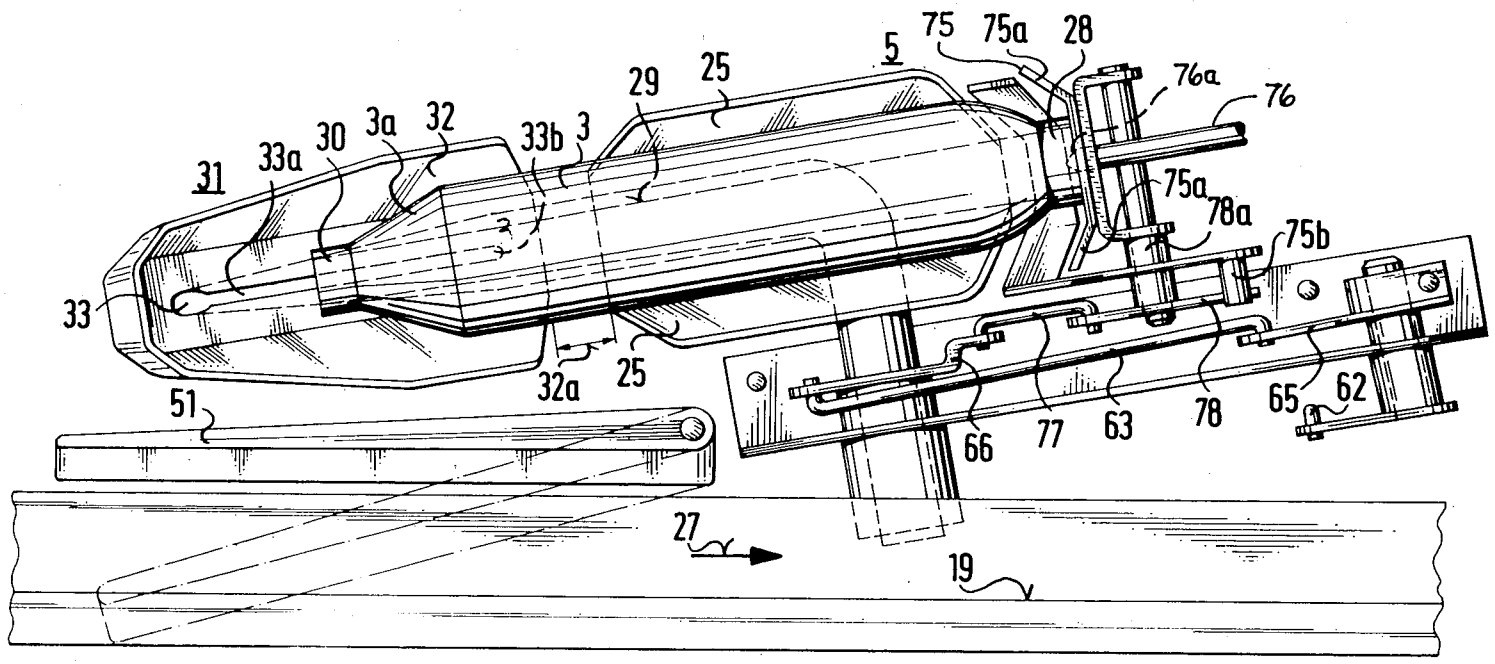
FIG. 2 is a top plan view of the cop receptacle of the winding station of FIG. 1.

The cops 20 should be transported along the upper run of the conveyor 19 with the exposed foot portion 28 of the yarn supporting tub thereof oriented as the leading cop end and with the exposed nose portion 30 of the yarn supporting tube oriented as the trailing yarn end, as viewed with respect to the direction of conveyor movement indicated by arrow 27 in FIG. 2. Thus, when a cop 20 is deflected into the cop-receiving receptable 25 at the reserve position 5, as represented by cop 3 in FIGS. 2 and 3, the foot portion 28 of the cop 3 is received within the trough-like receptacle with the nose portion 30 extending outwardly therefrom.

According to the present invention, a yarn suction device, indicated generally at 31, is affixed to the cop-receiving receptacle 25 for disposition adjacent the nose portion 30 of a cop 3 received by the receptacle 25. The yarn suction device 31 comprises a suction body 32 of a generally rounded configuration for partially surrounding the nose portion 30 of the cop 3. A suction passageway is formed in the body 32 and terminates in a suction nozzle opening 33 within the interior of the suction body 32 to be forwardly of the nose portion 30 of a cop 3 received in the receptacle 25. The suction passageway through the suction body 32 is connected to one end of a suction line 34 which extends axially through the pivot bearing 23 for the receptacle 25 and is connected at the opposite end, represented at 35 in FIG. 1, to a suitable vacuum source (not shown).

Figure 3:
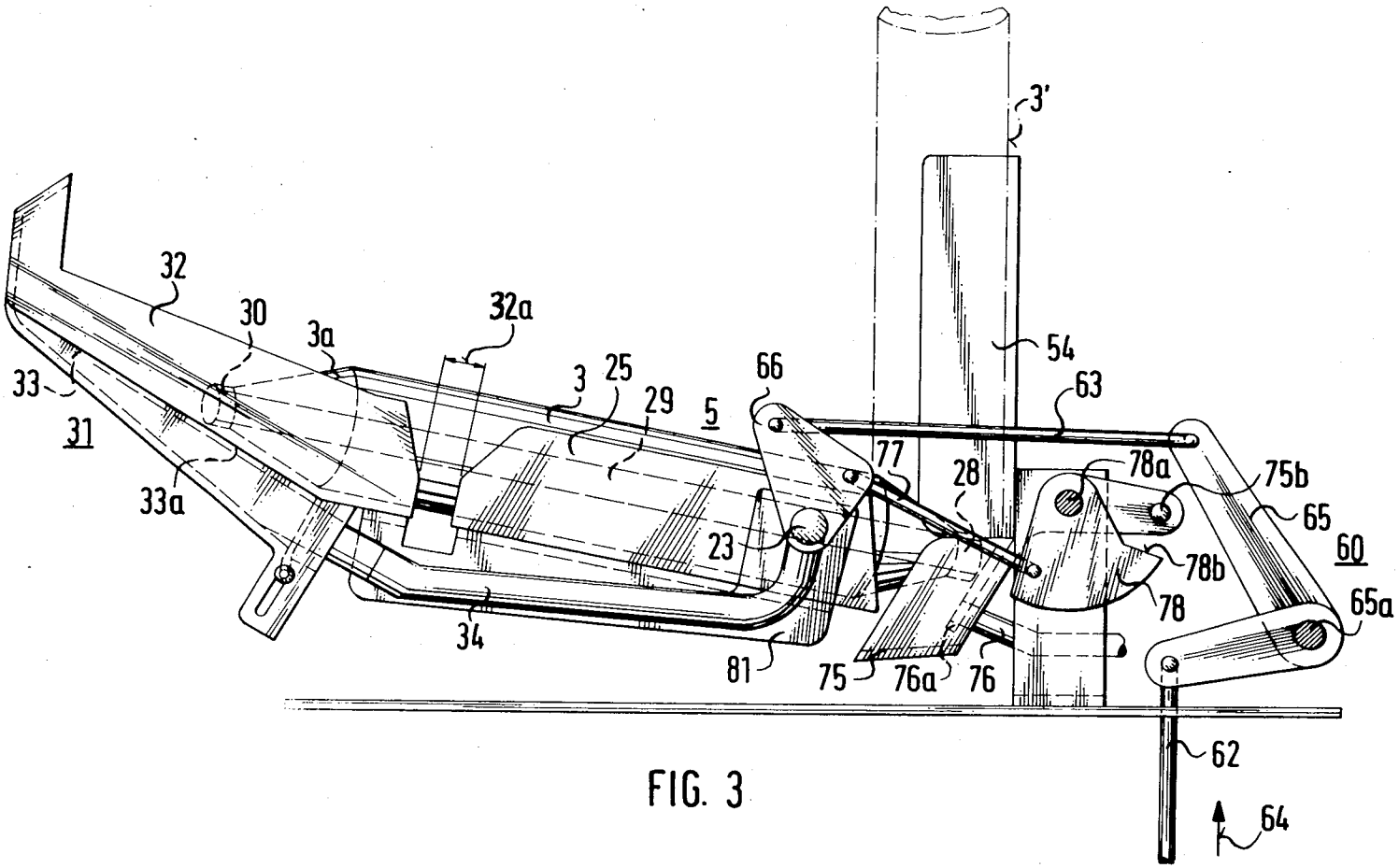
FIG. 3 is a front elevational view of the receptacle of FIG. 2, omitting the cop conveyor system.

The suction nozzle 33 is preferably formed as an elongated suction slot **33*a* opening along the bottom area of the interior of the rounded suction body 32 to extend substantially parallel to a yarn cop 3 when received within the trough-like receptacle 25. The elongated extent of the slot 33*a* is sufficient to extend from forwardly of the nose portion 30 of the cop 3 and along the full conical portion 3*a* and partially along the cylindrical portion of the yarn build-up of the cop 3 as illustrated in FIGS. 2 and 3. As previously indicated, each cop 20 delivered along the conveyor belt 19 will have been previously prepared with the leading yarn end thereof located for ready access, such as being inserted within the interior of the yarn supporting tube at its nose portion 30. Thus, the suction device 31 is operable to draw the leading yarn end out from within the interior of the nose portion 30 of the cop 3 and therefrom into the slot 33*a* to its end 33*b*. In this manner, the leading yarn end will extend from the conical portion 3*a* of the yarn buildup on the cop 3 directly to the end 33 *b* of the suction slot 33*a*, whereby no further yarn can be removed by suction from the nose end 30 of the cop 3**.

It will thus be apparent from the drawings that the rounded suction body 32 is configured essentially as an extension of the cop-receiving trough-like receptacle 25. The orientation of the suction slot **33*a* within the bottom of the interior of the suction body 32 insures a parallel relationship of the suction slot 33*a* with a reserve cop received within the receptacle 25. Additionally, the elongated nature of the suction slot 33*a* together with its parallel orientation with respect to the reserve cop 3 provides the advantage that the suction nozzle 33 will readily adapt for operation with cops of differing lengths and yarn build-up formats without requiring any adaptive positioning of the nozzle 33**.

The suction body 32 of the yarn suction device 31 is affixed to the cop-receiving receptacle 25 by a holder 81 shown in FIG. 3. As will thus be understood, the trough-like receptacle 25 and the suction body 32 pivot as a common unit about the bearing 23 between the aforedescribed flat and inclined disposition of the receptacle 25. Actuation of such pivoting movement is accomplished by a lever system 60 (FIGS. 2 and 3) of the same design as disclosed in German Offenlegungsschrift No. DE-OS 35 14 935. Particularly, an actuating rod 62 is arranged for reciprocal movement as indicated by the directional arrow 64 by which a lever 65 is pivoted about a stationary shaft 65a, the lever 65 in turn actuating pivotal movement of another lever 66 through an intermediate connecting rod 63. The lever 66 pivots the cop-receiving receptacle 25 about the axis 24 of its support bearing 23 (FIG. 1) for moving the reseve cop 3 from its position supported within the receptacle 25 in its flat cop-receiving disposition as shown in full lines in FIG. 3, into a generally upstanding inclined disposition, shown at 3' in broken lines in FIG. 3 as well as in FIG. 1. In the inclined disposition of the cop 3', a retainer plate 54 (FIG. 3) prevents the cop 3' from falling outwardly from the trough-like receptacle 25.

A baffle member 75 is mounted pivotably about a shaft 78a at the end of the receptacle 25 opposite the suction device 31 to act as a stop support for the foot portion 28 of a reserve bobbin 3 when received by the receptacle 25 in the flap cop-receiving disposition thereof and for movement away from the receptacle 25 when in its upwardly inclined disposition to permit discharge of the reserve cop. Pivoting of the baffle member 75 is actuated by a connecting rod 77 articulated at one end to the lever 66 attached to the bearing 23 and articulated at the opposite end to another lever 78 which is also pivotably mounted about the shaft 78a. Thus, when the cop-receiving receptacle 25 is pivoted upwardly into its inclined disposition, the lever 78 is caused to pivot counterclockwise (as viewed in FIG. 3) until an edge portion 78b thereof strikes a pin 75 *b* on the baffle member 75. Thereafter, the baffle member 75 is caused to pivot counterclockwise about the shaft 78a simultaneously as the lever 78 continues to pivot counterclockwise thereabout. In this manner, as the receptacle 25 reaches its inclined disposition of FIG. 1, the baffle member 75 has moved sufficiently away therefrom to permit the reserve cop 3 to gravitationally fall from the upright disposition 3' (FIG. 3) onto a discharge chute 40 (FIG. 1) beneath the bracket 16 which is configured to direct the reserve cop 3 to slide onto the support pin 15 in its receiving position 15' of FIG. 1.

As will be seen in FIG. 3, the baffle member 75 remains somewhat inclined with respect to the foot portion 28 of reserve cop 3 when the receptacle 25 is in its flat cop-receiving disposition. The baffle member 75 includes contoured lateral guide portions 75a, but the foot portion 28 of a reserve cop 3 within the receptacle 25 does not slide into guided contact with the guide portions 75a until the receptacle 25 is actuated to begin upward pivotal movement toward its inclined disposition. In this manner, the reserve cop 3 is positioned with respect to the baffle member 75 while the receptacle 25 is in its flat cop-receiving position so that the mouth 76a of a blower nozzle 76 mounted to the baffle member 75 may discharge a positive air flow from a remote blower (not shown) directly into the axial interior bore 29 through the yarn supporting tube of the reserve cop 3. Thus, substantially the full strength of the current of blown air is assured to pass through the tube bore 29, even in the case of differing sizes and winding formats of yarn cops, to assist the suction device 31 in withdrawing the leading yarn end from within the interior of the nose portion 30 at the opposite end of the reserve cop 3, as previously described.

For the sake of clarity, the baffle member 75, together with its guide portions 75a and its actuating components, are not shown in FIG. 1. However, as will be understood, as soon as the reserve cop 3' shown in FIG. 1 slides from the cop-receiving receptacle 25 along the chute 40 onto the supporting pin 15', the leading extent of the yarn from the cop 3' will extend from the nose portion 30 of the cop 3' on the supporting pin 15' upwardly to the end 33b of the suction slot 33a of the suction device 31. As will be noted from the drawings, the holder 81 mounts the suction body 32 at a spacing 32a from the cop-receiving receptacle 25. A yarn gripper arm 80 is pivotably mounted at 79 on the plate 21 for pivotal movement through the intermediary area 32a between the full and broken line positions shown respectively at 80 and 80' in FIG. 1, whereby the leading portion of yarn extending from the cop newly positioned at the delivery position 4 to the suction device 31 may be moved to assume the disposition shown at 67 in FIG. 1. In this disposition, the yarn 67 may then be introduced to the winding station 1 in the manner disclosed in German Offenlegungsschrift DE-OS No. 35 14 935 by engagement of the yarn 67 by a yarn transfer device 68 pivotably supported at 69 for movement of the yarn 67 to the winding station 1 whereat the leading end of the yarn may be knotted or spliced to a trailing yarn end from the cross-wound bobbin 12.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a bobbin winding machine having a plurality of yarn winding stations each including a cop delivery position wherein an active yarn cop may be disposed for yarn unwinding therefrom and a cop reserve position wherein a reserve yarn cop may be disposed awaiting replacement of the active cop in the delivery position, conveyor means extending along the machine for transporting cops to the reserve positions, and receptacle means at each reserve position movable between a disposition for receiving a reserve cop from the conveyor means and another disposition for discharging the reserve cop for transportation to the delivery position, the improvement comprising yarn suction means at each winding station affixed to and movable with the receptacle means for disposition adjacent a nose portion of a reserve cop received thereby for locating and retaining a leading yarn end of the reserve cop.

2. The improvement in a bobbin winding machine according to claim 1 and characterized further in that said yarn suction means comprises a suction body of a generally rounded configuration to partially surround the nose portion of a reserve cop when received by the receptacle means, said suction body defining a suction nozzle for disposition adjacent the nose portion of the reserve cop.

3. The improvement in a bobbin winding machine according to claim 2 and characterized further in that said suction nozzle includes a suction slot oriented to be generally parallel to a reserve cop received by the receptacle means.

4. The improvement in a bobbin winding machine according to claim 3 and characterized further in that said suction slot is located generally at a bottom portion of the interior of said body.

5. The improvement in a bobbin winding machine according to claim 1 or 4 and characterized further by a bearing mounting the receptacle means for pivotal movement between its receiving and discharging dispositions, said yarn suction means being operatively connected to a suction line extending axially through the bearing.

6. The improvement in a bobbon winding machine according to claim 1 and characterized further by a blower nozzle arranged for directing a positive air flow axially into a foot portion of a reserve cop received by the receptacle means.

7. The improvement in a bobbin winding machine according to claim 6 and characterized further by a stop member having guide portions arranged for engagement with the foot portion of the reserve cop received by the receptacle means when in its receiving disposition.

* * * * *